United States Patent [19]

Schwarz

[11] Patent Number: 4,863,413

[45] Date of Patent: Sep. 5, 1989

[54] BIRD SHAPED TOY GLIDER

[76] Inventor: Charles F. Schwarz, 168 David Dr., Palatine, Ill. 60067

[21] Appl. No.: 179,859

[22] Filed: Apr. 11, 1988

[51] Int. Cl.[4] ..... A63H 27/00

[52] U.S. Cl. ..... 446/62; 446/34; 446/68

[58] Field of Search ..... 446/34, 61–64, 446/66, 67, 68

[56] References Cited

U.S. PATENT DOCUMENTS

| | | | |
|---|---|---|---|
| 1,599,280 | 9/1926 | Lewis | 446/62 |
| 1,771,991 | 8/1930 | Bissiri | 446/63 X |
| 1,842,434 | 1/1932 | Tyrrell | 446/63 X |
| 2,059,131 | 10/1936 | McGall | 446/62 |
| 2,128,747 | 8/1938 | Johnson | 446/63 X |
| 2,145,972 | 2/1939 | Clark et al. | 446/63 X |
| 2,221,012 | 11/1940 | Walker | 446/63 X |
| 2,268,487 | 12/1941 | Jacobs | 446/63 X |
| 2,512,069 | 6/1950 | Mull | 446/62 |
| 3,222,817 | 12/1965 | Brandstetter | 446/62 |
| 3,839,818 | 10/1974 | Heggedal | 446/68 X |
| 4,170,082 | 10/1979 | Freedman | 446/77 X |
| 4,253,897 | 3/1981 | Putone | 446/34 X |

FOREIGN PATENT DOCUMENTS

| | | | |
|---|---|---|---|
| 2400678 | 8/1974 | Fed. Rep. of Germany | 446/62 |
| 776303 | 1/1935 | France | 446/63 |

*Primary Examiner*—Robert A. Hafer
*Assistant Examiner*—D. Neal Muir
*Attorney, Agent, or Firm*—Charles F. Meroni, Jr.

[57] ABSTRACT

A bird shaped toy glider which is preferably comprised of Styrofoam and includes a body. The body has a laminated head structure. A metal weight is embedded in the head between the laminations of the head structure for balancing the glider. A collapsible wing structure is provided and it includes a pair of wings mounted on the body behind the head. The body having its center of gravity at a medial point between opposite ends of the body. A tail structure is mounted on the rear end of the body. A stationary pivot pin is fixedly secured with and extends through the body behind the wings. Resilient spring-like means in the form of a rubber band operates to secure the collapsible wing structure on the body permitting the collapsible wings to be pivoted about the stationary pivot pin in a 90° forward direction from a "free flight position" and further permits the wings to be folded back into flat abutment against opposite sides of the body in a direction rearward of the center of gravity of the toy glider into a "glider launch position". The rubber band serves a means to further co-act with the wings to move the wings from their "glider launch position" into the "free flight position" when air pressure from launching has diminished sufficiently so that the resilient spring-like means can then move the wings back into the "free flight position".

19 Claims, 2 Drawing Sheets

BIRD SHAPED TOY GLIDER

BACKGROUND OF THE INVENTION

The present invention relates generally to a bird shaped toy glider of a type that can be hand launched or which is preferably launched by a launching device comprised of a stick or rod and a rubber band. The rubber band is fastened to the rod and the rubber band engages a notch in the head of the glider. When the person launching the glider pulls the glider away from the rod, the rubber band is stretched and when the glider is released, the glider is then propelled into the sky.

According to the important features of my invention, I have provided a new and improved bird shaped glider that costs less, weighs less and flies better than any other glider of its type known to me. To this end, I have found that by manufacturing my glider of a Styrofoam material that the weight of the glider can be maintained at a level of ½ ounce or less. By using a launcher of a type known in the art, this light weight glider can be propelled high into the sky.

According to other features of my invention, I have provided a collapsible wing structure which has a unique mounting arrangement for mounting the wing structure upon the glider as all is described in further detail herein. In order to maintain the glider in an aerodynamically balanced state, I have provided a weight or washer in the head of the glider and this assists in obtaining a desirable flight characteristic for my new bird shaped toy glider.

In the past, a number of gliders have existed and the most pertinent patents known to me are listed below, as follows:

| Patent No. | Patent Title | Patentee |
|---|---|---|
| 802,329 | Flying Target | Edward S. Schmitt |
| 1,920,746 | Airplane Toy | R. M. Guillow |
| 2,059,121 | Toy Airplane | P. K. McGall |
| 2,136,067 | Toy Airplane | Emile A. Wittle |
| 2,221,012 | Toy Glider | N. E. Walker |
| 2,588,941 | Model Glider | E. A. Stark |
| Re.25,734 | Time Delay Action and Release for Airborne Toys | A. H. Boese |
| 4,125,960 | Toy Glider | Charles R. Bacca |
| 4,324,064 | Toy Aircraft | Pierre A. Bettencourt et al |

From a study of the patents listed above, it appears that none of them have the desirable structural features that I have developed. The patents relate to old types of gliders where balsa wood was used. It is well-known that where balsa wood is used that this material is highly fragile, and there is a high tendency for the material to become damaged in a short time such as where the wings crack and the tail structure cracks or becomes broken, etc. Also, the balsa wood construction is more expensive and the life of a balsa wood glider is not believed to be as long as the life of my new glider. While U.S. Pat. No. 2,221,012 shows a glider having wings that are adapted to open from their folded position when its velocity through the air decreases below a predetermined value low enough that said glider will have reached nearly its maximum height as a dart, as described in the patent, I have provided a new and improved way of mounting of collapsing wing structure upon a light weight Styrofoam body structure which is of superior design and particularly suited for use with lighter weight and lower cost material such as Styrofoam which is the preferred material used for my glider construction.

In view of the foregoing, it will be appreciated that it is an important object of my invention to provide a new and improved bird shaped toy glider which is lighter in weight than any other glider known to me, and yet is sufficiently strong that it may be gripped in the hand to apply tension to a resilient member, which, when release, will propel the bird shaped glider high into the air, which glider because of its unique structural characteristics has more durability and life than any other glider known to me.

SUMMARY OF THE INVENTION

A bird shaped toy glider comprised of a Styrofoam and including a body, the body having a laminated head structure, a metal weight embedded in the head between the laminations of the head structure for balancing the glider, a collapsible wing structure including a pair of rotatable wings mounted on the body behind the head, the body having its center of gravity at a medial point between opposite ends of the body, a tail structure mounted on a rear end of the body, a stationary pivot pin fixedly secured with and extending through said body behind said wings, a pair of tough sturdy bendable synthetic plastic tabs rotatably mounted on said pivot pin on opposite sides of said body, said tabs being secured with said wings and rotatable with said wing from a "glider launch position" to a "free flight position", and resilient springlike means attached to the body forward of the synthetic plastic tabs to aid in more promptly bringing the wings to the "free light" flight position and biasing the collapsible wing structure on the body permitting the collapsible wings to be pivoted about said stationary pivot pin in a 90° forward direction from the "free flight position" and further permitting the wings to be folded back into flat abutment against opposite sides of the body in a direction rearward of the center of gravity of the toy glider into the "glider launch position", the wings being positioned behind said stationary pivot pin on opposite sides of said body when the wings are in the "glider launch position" for assisting in stabilizing the wings before the glider is launched, the pivot pin being positioned above the wings in stabilizing abutment therewith when the wings are in the "free flight position", said means cooperating with the wings enabling them to be rotated with said tough sturdy bendable synthetic plastic tabs on said stationary pivot enabling the wings to be actuated from their "glider launch position" into the "free flight position" when air pressure from launching has diminished sufficiently so that the said resilient spring-like means can then force the wings to be rotated back into the "free flight position".

A bird shaped toy glider comprised of a synthetic plastic material having the lightness and durability of a material such as Styrofoam and including a body, the body having a laminated head structure, a metal weight embedded in the head between the laminations of the head structure for balancing the glider, a collapsible wing structure including a pair of wings mounted on the body behind the head, the body having its center of gravity at a medial point between opposite ends of the body, a tail structure mounted on a rear end of the body, a stationary pivot pin fixedly secured with and extending through said body behind said wings, and resilient spring-like means attached to the body forward of the synthetic plastic tabs to aid in more promptly bringing the wings to the "free flight" position and securing the collapsible wing structure on the body permitting the collapsible wings to be pivoted about said stationary pivot pin in a 90° forward direction from a "free flight position" and further permitting the wings to be folded back into flat abutment against opposite sides of the body in a direction rearward of the center of gravity of the toy glider into a "glider launch position", said means cooperating with the wings enabling them to be released from their "glider launch position" into the "free flight position" when air pressure from launching has diminished sufficiently so that said resilient spring-like means can then force the wings back into the "free flight position", said means comprising a rubber band extending through a hole in said body at a point above said stationary pivot and being attached at its opposite ends to an topside of said wings to impose a force upon said wings tending to cause the wings to move from said "glider launch position" to said "free flight position" the stationary pivot pin having a sufficient length so that as the wings are collapsed rearwardly the rubber band will move beneath the stationary pivot pin in guided engagement therewith, said rubber band being stretched beneath and engaged against an underside structure is in its "glider launch position" to assist in controlling the movement of the rubber band and the wings as the collapsed wings move to said "free flight position", the fixed stationary pivot pin being engaged against a topside of both wings on opposite sides of the body when the wing structure is in either its "free flight position" or its "glider launch position".

According to important features of my invention, I have provided a stationary stop means that is fixedly secured on the body positioned above the stationary pivot pin and which is cooperable with inside edges of the wings on opposite sides of the body to inhibit rotational movement of the wings to a point forwardly of the stationary pivot pin when the collapsible wing structure is in its "glider launch position".

According to other features of my invention, I have provided spring-like means in the form of a rubber band which extends through a hole in said body at a point above the stationary pivot and being attached at its opposite ends to a topside of the wings to impose a force upon the wings tending to cause the wings to move from the "glider launch position" to the "free flight position", the rubber band being stretched beneath and engaged against an underside of the pivot pin when the collapsible wing structure is in its "glider launch position" to assist in controlling the movement of the rubber band and the wings as the collapsed wings move to the "free flight position".

Yet other features of my invention relate to a bird shaped toy glider having a U-shaped clip and with the U having its closed end engaged against an upper edge of the body when the winds are in the "free flight position" and with the U-shaped clip spaced from the body and overlying the pivot when the wings are in the "glider launch position", and opposite free ends of the U-shaped clip being joined with the wings in assembly therewith.

BRIEF DESCRIPTION OF THE DRAWINGS

According to other objects and features of my invention will more fully become apparent in view of the following detailed description of the drawings illustrating the single embodiment.

DESCRIPTION OF THE PREFERRED EMBODIMENTS

The reference number 10 indicates generally a bird shaped toy glider and this glider embodies important features of my invention. The glider is preferably made from Styrofoam and I have found that there is considerable advantage where Styrofoam is used in the construction of my toy glider as opposed to balsa wood and other materials. Styrofoam is very light and has an inherent certain strength to it which have enabled me to obtain excellent results in my manufacture and testing of my glider 10. It is possible that other synthetic plastics could be used in place of Styrofoam, but this is the best material that is known to me at the present time.

Figures 1, 2, 3, 3A:
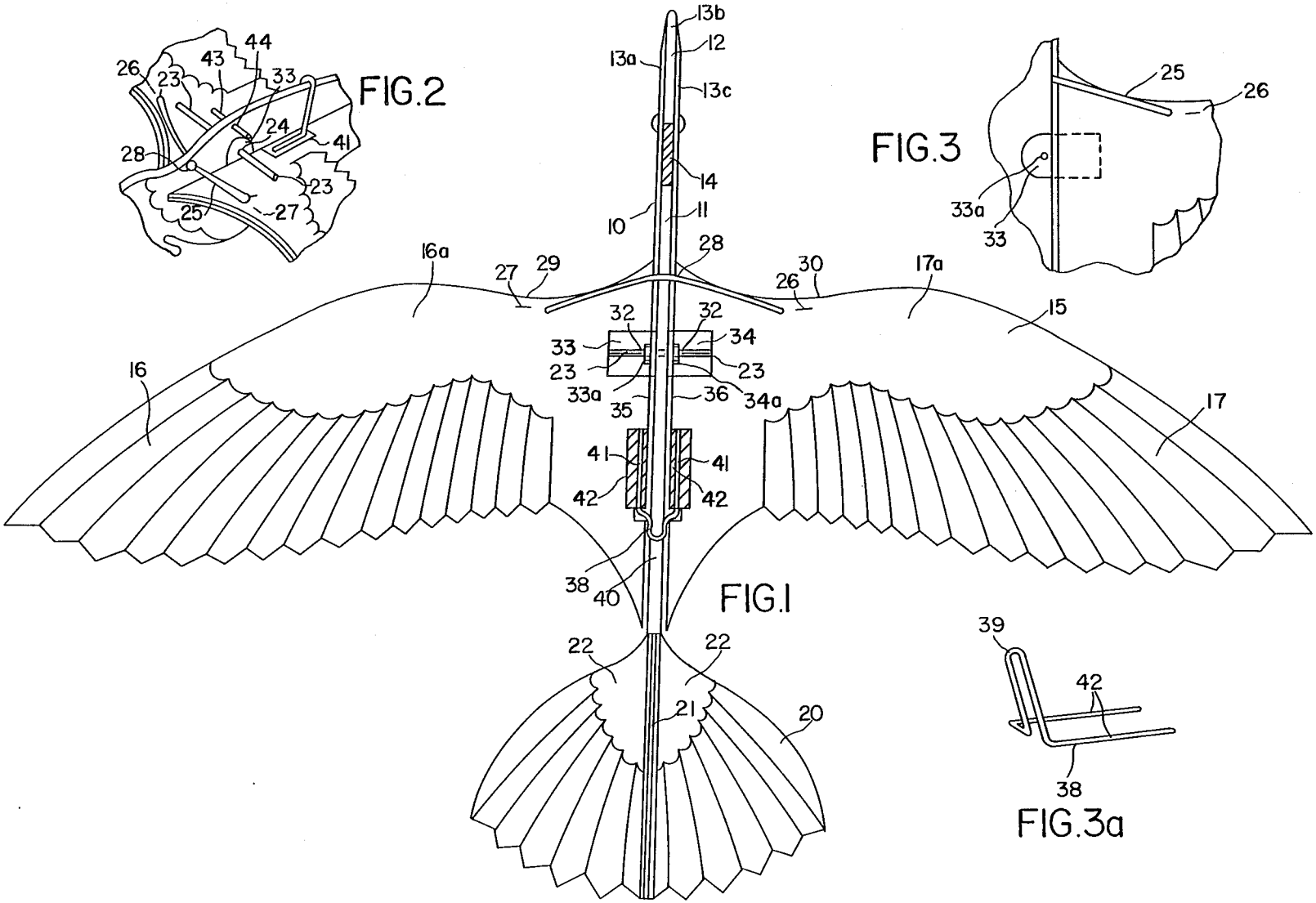
FIG. 1 is a top plan view of my bird shaped toy glider.
FIG. 2 is a diagramatic perspective view of a portion of my bird shaped toy glider showing the details of the mounting of wings on my glider.
FIG. 3 is a fragmentary diagramatic view of my bird shaped toy glider illustrating the way in which the one wing is mounted upon the body when the wing is positioned co-planar to the body.
FIG. 3*a* is a prespective view of the saddle clip which is one of the components for mounting the collapsible wing structure upon the bird shaped glider.
Figure 4:
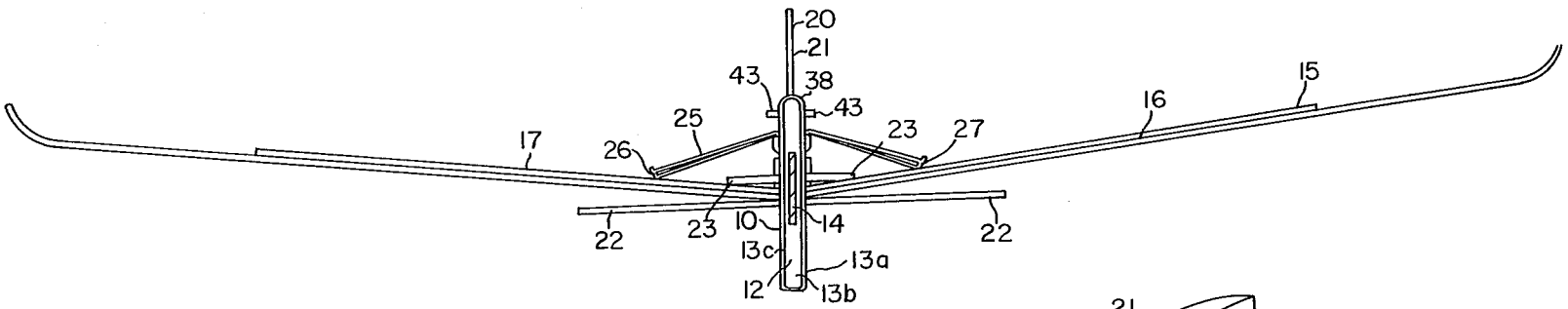
FIG. 4 is a front elevation of my toy glider.

The glider 10 includes a body 11. The body is in the shape of a bird and is also made of Styrofoam. The body 11 has a laminated head structure 12 including a series of three plies. 13*a*, 13*b* and 13*c*. (FIG. 1) A metal washer or weight 14 is embedded in the head 12 of the glider and is lodged between the laminations 13*a*, 13*b* and 13*c* in a predetermined location to provide dynamic balance to the glider 10. Where the glider weighs approximately one-half an ounce, and is constructed as shown in the drawings as attached herewith excellent results can be obtained by using a washer or weight 14 that weighs approximately $\frac{1}{4}$ ounce. Excellent results can also be obtained by locating the weight along a medial line extending the length of the glider 10 centered between the outside plies 13*a* and 13*c* of the head 12, as shown in FIGS. 1 and 4.

In accordance with important features of my invention, I have provided a collapsible wing structure 15 that includes a pair of wings 16 and 17. The wings 16 and 17 are mounted on the body 11 behind the head 12. The body 11 has its center of gravity at a medial point 18 between opposite ends of the body as indicated by the diagramatic line 19 (FIG. 5) located between opposite ends of the body. A tail structure 20 is mounted in on a rear end of the body 11 and includes an upright tail portion 21 and laterally extending horizontally aligned tail portions 22–22.

A pivot pin 23 is secured with the body 11 and extends through a hole 24 in the body behind the wings. The pin 23 can be made of any suitable material such as the material analogous to or like a wooden stick or pin of the same character as a toothpick. Preferably, where the body 11 is dimensioned as previously described, the pin 23 should be 1½" in length. While this length could be varied, excellent results can be attained by making the pin of this dimension. The pivot pin 23 is quite important since it serves to maintain the wings 16 and 17 in a level position during flight. The dihedral shape of the wings is maintained by the critical placement by the pin 23 through the center of the body 11. With a wing structure 15 having a span of 16", I have found that excellent results can be attained by making the pin 23 1½" long and by positioning the pin in centered relationship relative to the body 11, and in such a way that the pin extends physically through the body in locked assembly as will be described in further detail hereafter. A rubber band 25 also contacts with the pin in maintaining the wing structure in proper flight position as the glider may be buffeted by winds when in flight. Still further, the pin 23 serves to assist in guiding the rubber band 25 in its movement when the wings are collapsed for launching and then when the wings are released for glider flight. It will also be observed that the pin 23 is blocked in position on the body 11 as metal washers are mounted on opposite sides of the body in assembly with the pins to insure that the pin 23 cannot move and is maintained at all times in locked position with the body against rotation and against transverse movement across or relative to the body 11 itself. The pivot pin 23 provides an important function, and is a feature of my invention insofar as it co-acts with the wings 16 and 17 for enabling the wings to move from a "free flight position" to a "glider launch position".

Figure 8:
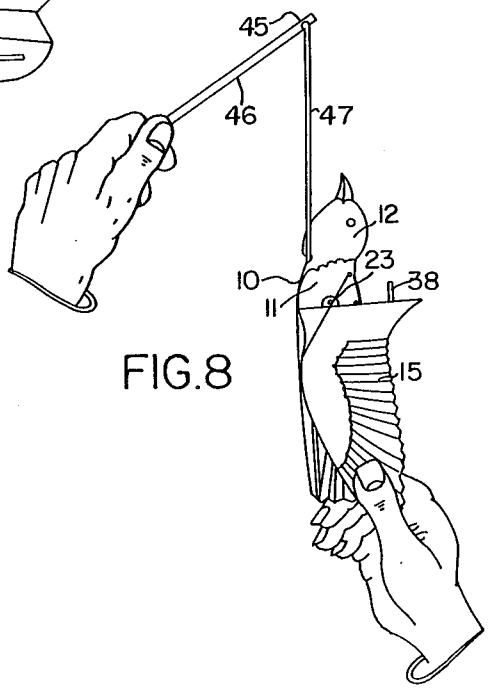
FIG. 8 is a side elevation of my bird shaped toy glider when in its "glider launch position" and further illustrating a launching stick and a rubber band engaged with my glider for launching the same.
Figure 7:
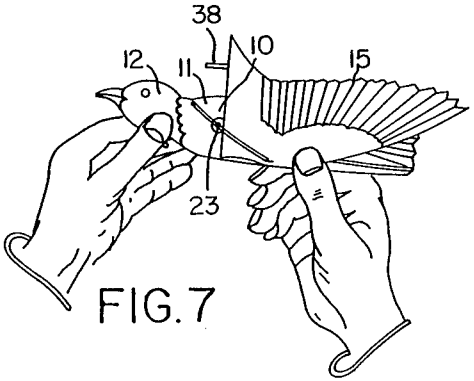
FIGS. 6 and 7 are side elevations of my glider illustrating the way in which the collapsing wing structure may be hand manipulated to progressively move the wing structure from a "free flight position" to a "glider launch position"
Figure 6:
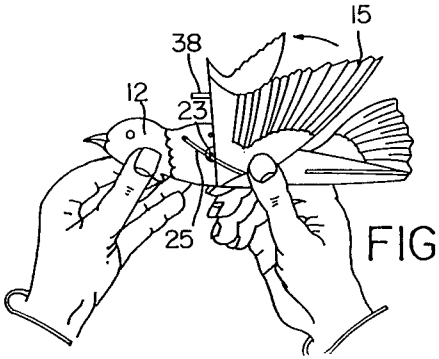

According to other features of my invention, the rubber band 25 is provided and it functions as a resilient spring-like means for securing the collapsible wing structure on the body for permitting the collapsible wings to be pivoted about the pivot pin 23 in a 90° forward direction from a "free flight position", and further permitting the wings 16 and 17 to be folded back into flat abutment against opposite sides of the body 11 in a direction rearward of the center of gravity 18 of the toy glider into a "glider launch position" as shown FIG. 6, 7 and 8. FIG. 6 and 7 show the collapsing action of the wing 16 and 17, and FIG. 8 shows the wings in a so-called "glider launch position". As stated before, the rubber band 25 co-acts with the wings enabling them to be leased from their "glider launch position" into the "free flight position" when air pressure from launching has diminished sufficiently so that the resilient spring-like means or rubber band 25 can then force the wings back into the "free flight position". The rubber band 25 is a number 16 size 2½"×1/16".

From a study of the drawings, it will be seen that the rubber band 25 which serves to hold the collapsing wing structure 15 in its "free flight position" and also co-acts to maintain the wing structure 15 in its "glider launch position" is secured to the wings 16 and 17 by means of up turned ends 26 and 27 of metal staples embedded through the wings. These metal staples are extended so that the prongs of the staples are located on the top side of the wings 16 and 17, and as indicated the ends of the rubber band 25 are hooked on the staple prongs 26 and 27 to maintain the rubber band in a taut position. The rubber band also extends through a hole 28 in the body 11, and this hole is positioned vertically above leading edges 29 and 30 of the wings 16 and 17. In order to insure an adequate support for the staples and the prongs 26 and 27 provided by the staples, the wings 16 and 17 are each provided with an additional lamination **16*a* and 17*a* to (FIG. 1) in effect double the thickness of the wings in certain areas to provide a reinforced more sturdy Styrofoam wing structure. The prongs 26 and 27 each extend above the associated wing ⅛" and are inclined in diverging relation relative to one another and relative to the associated wing so that opposite ends of the rubber band 25 can be securely lodged in assembly with the staple prongs 26 and 17. Excellent results can be obtained by manufacturing the wing structure from a Styrofoam material where the normal thickness of the wing is 1/16 of an inch, but where the extra lamination is provided the wings are of a ⅛ inch thickness. The body itself is preferably of a 3/16 of an inch thickness. The tail structure 20** is normally of a 1/16 of an inch thickness.

Now in order to reinforce the connection of the pivot pin 23, I have provided the body 11 with a pair of metal washers 32–32 (FIG. 1). Still further, in order to physically connected the wings 16 and 17 with the pivot pin 23, a pair of tough sturdy synthetic plastic tabs 33 and 34 are physically joined with inside bird body engaging edges 35 and 36 in unitary assembly between the laminations **16–16*a* and 17–17*a* in bonded assembly therewith. Any suitable material may be used to secure the bonded laminations of the wings together with the tabs 33 and 34. There are a number of commercially available glues that can be used for this purpose. The tabs 33 and 34 are provided with holes 33*a* and 34*a*, and it is through these holes that the pivot pin 23 extends to physically connect the body engaging wing edges 35 and 36 with the body through the pivot pin 23**.

Now in order to stabilize the body engaging wing edges 35 and 36 of the wing structure 15 at rear ends of the wings, I have provided a U-shaped clip 38. The clip is of a U-shape and has a closed end 39 which is adapted to engage a top edge 40 of the body 11 when the wing structure 15 is in its "free flight position". The clip 38 acts as a saddle in the way that it rides upon the top of the body when the wings are in their "glider flight position". The free ends of the saddle clip are shown in dotted lines in FIG. 1, and are embedded in the material of the wings or can be taped to the wings, as desired. It will be further noted that when the wing structure 15 is in its "glider launch position" (FIGS. 6, 7 and 8) that this U-shaped clip 38 overlies the pivot pin 23. At that point in time, it will further be seen that the rubber band 25 is engaged against an underside of the pivot pin 23. Now in order to secure the metal clip 38 to the wings 16 and 17, the clip is provided with outer clip legs or ends which extend generally parallel to or parallel with the body engaging wing edges 35 and 36 of the wings 16 and 17. These clip ends or legs are taped to the wings 16 and 17 by pieces of tape indicated at 41. It will be noted that the legs 42 of the U-shaped saddle clip are approximately 1" length. By providing legs of this length, the saddle clip can be firmly anchored with the wings 16 and 17 in fixed assembly therewith. The upright portion of the saddle 39 extends at an incline rearward angle relative to the legs 42—42 to enable the angle of attack of the wings 16 and 17 to be adjusted. The legs of the clip 38 that are taped to the wings 16 and 17 are illustrated by the dotted lines shown at 42—42 on opposite sides of the body 11 in FIG. 1.

Figure 5:
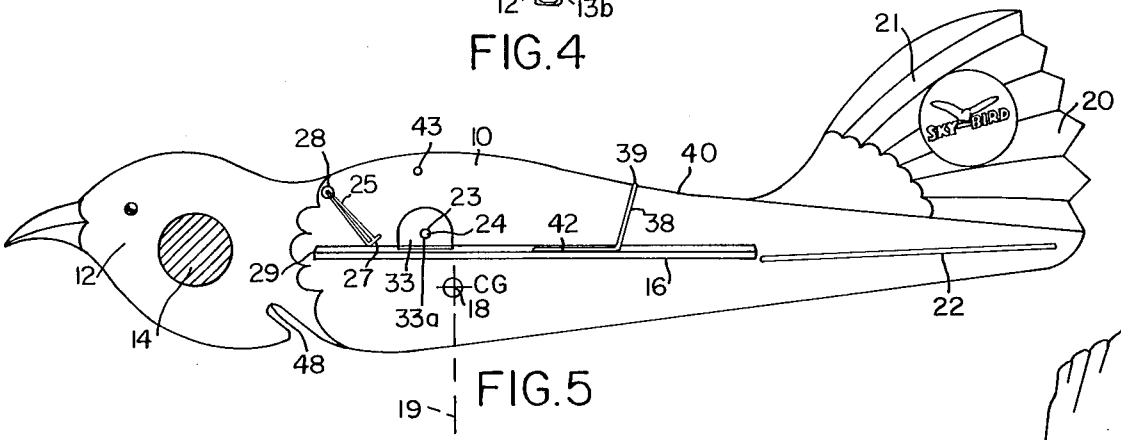
FIG. 5 is a side elevation of my toy glider with a metal weight being shown in full lines for illustrative purposes.

In order to further assist in the collapsing of the wing structure 15 and to restrict movement of the wings 16 and 17 when moved from a "free flight position" to a "glider launch position", I have provided a second stationary or fixedly mounted stop pin 43. This stop pin is shorter in length than the pivot pin 23, and is shown in FIGS. 4 and 5. The pivot pin 23 may be a 1¾" toothpick of 1/16" diameter or a wooden dowl. This stop pin 43 extends through a hole in the body indicated at 44 (FIG. 2) and acts as a stop so the wings 16 and 17 cannot move forward after the glider has been launched from its "glider launch position" enabling the folded wings to move forward to their "free flight position". Importantly, the two rods or pins 23 and 43 are stationary when attached to the body 11. The pin 43 is preferably ¾" long and is also wedge fitted in locked position with the body 11 so that it cannot rotate or move transversely with the body.

My invention is a flying bird shaped glider that has its wings folded along the bird's body before it is launched. It is then hand launched toward the open sky by means of a rubber launcher. When the bird or glider reaches its maximum apex, the bird's wings open to a flying position and continues to fly to greater heights before gliding to the ground and landing. FIGS. 6, 7 and 8 show the sequence of hand launching. As you can see, you manually rotate the wings forward (FIG. 6). FIG. 7 shows how the wings are manually folded back along sky bird's body on top of the tail. In order to launch the bird shaped glider 10, I have provided a launcher 45 which includes a stick or rod or dowl rod 46 connected to a 7" rubber band 47. The dowl rod 46 has a 5/16" diameter and is 6" long. The rubber band 25, must I say this again must, be under the small wooden peg 23 and engaged with and guided by peg or pin 43 when the wing structure is in its "glider launch position". FIG. 8 illustrated how you loop the rubber band launcher into a notch 48 at the bottom of sky bird's head and holds sky bird's wings with thumb and forefinger and stretch your rubber band down, and then release sky bird or glider 10. You should always release sky bird straight up and fly in open areas. On the back of the wings, there is a concurve going back to the body, and that in turn has two purposes. It provides an increased square inch area for the wing for flying, and it also keeps the saddle wire in place and not falling out. So it has a two-fold purpose. In my preferred embodiment, this flying bird or glider only weighs about ½ ounce or less for very superior flight characteristics.

I claim:

1. A bird shaped toy glider comprised of Styrofoam and including a body, the body having a laminated head structure, a metal weight embedded in the head between the laminations of the head structure for balancing the glider, a collapsible wing structure including a pair of rotatable wings mounted on the body behind the head, the body having its center of gravity at a medial point between opposite ends of the body, a tail structure mounted on a rear end of the body, a stationary pivot pin fixedly secured with and extending through said body behind said wings, a pair of tough sturdy bendable synthetic plastic tabs rotatably mounted on said pivot pin on opposite sides of said body, said tabs being secured with said wings and rotatable with said wing from a "glider launch position" to a "free flight position", and resilient spring-like means attached to the body forward of the synthetic plastic tabs to aid in more promptly bringing the wings to the "free flight" position and biasing the collapsible wing structure on the body permitting the collapsible wings to be pivoted about said stationary pivot pin in a 90° forward direction from the "free flight position" and further permitting the wings to be folded back into flat abutment against opposite sides of the body in a direction rearward of the center of gravity of the toy glider into the "glider launch position", the wings being positioned behind said stationary pivot pin on opposite sides of said body when the wings are in the "glider launch position" for assisting in stabilizing the wings before the glider is launched, the pivot pin being positioned above the wings in stabilizing abutment therewith when the wings are in the "free flight position", said means cooperating with the wings enabling them to be rotated with said tough sturdy bendable synthetic plastic tabs on said stationary pivot enabling the wings to be actuated from their "glider launch position" into the "free flight position" when air pressure from launching has diminished sufficiently so that the said resilient spring-like means can then force the wings to be rotated back into the "free flight position".

2. The bird shaped toy glider of claim 1 further characterized by stationary stop means fixedly secured on said body positioned above said stationary pivot pin and being cooperable with inside edges of the wings on opposite sides of the body to inhibit rotational movement of the wings to a point forwardly of the stationary pivot pin when said collapsible wing structure is in its "glider launch position".

3. The bird shaped toy glider of claim 1 further characterized by the pivot pin comprising a wooden pin extending through the body, and means fixedly securing the pivot pin to said body to prevent its accidental engagement from the body.

4. A bird shaped toy glider of claim 3 further characterized by the center of gravity of the bird shaped toy glider being located rearwardly immediately behind said pivot pin.

5. The bird shaped toy glider of claim 1 further characterized by said means comprising a rubber band extending through a hole in said body at a point above said stationary pivot and being attached at its opposite ends to a topside of said wings to impose a force upon said wings tending to cause the wings to move from said "glider launch position" to said "free flight position", said rubber band being stretched beneath and engaged against an underside of said pivot pin when the collapsed wings are in their "glider launch position" to assist in controlling the movement of the rubber band and the wings as the collapsed wings move to said "free flight position".

6. The bird shaped toy glider of claim 1 further characterized by said means comprising a rubber band extending through said body at a point above said pivot and being attached to a topside of each of said wings imposing a force upon said wings to cause the wings to be movable from their folded position to close adjacency to the body of their "free flight position" to cause the wings to rotate forwardly 90° and to cause the wings to move outwardly and away from opposite sides of the body.

7. The bird shaped toy glider of claim 1 further characterized by including a U-shaped clip and with the U having its closed end engaging against an upper edge of the body when the wings are in said "free flight position" and with said U-shaped clip spaced from the body and overlying the pivot when said wings are in said "glider launch position", and opposite free ends of the U-shaped clip being joined with said wings in assembly therewith.

8. The bird shaped toy glider of claim 1 further characterized by outer tip ends of said wings being positioned on opposite sides of said body at the area of said tail structure enabling a person to grasp the outer tip ends of the wings between a person's thumb and forefinger for launching the glider when it is in its "glider launch position".

9. The bird shaped toy glider of claim 1 further characterized by said laminated bird head structure having a downwardly and rearwardly opening notch and a second rubber band insertable in said notch to assist in the propulsion of the bird when using a stick connected to a foward opposite end of the second rubber band for launching the glider from its "glider launch position" into free flight, the bendable tab being in a "flat position" when the pair of wings are collapsed against opposite sides of the body and the tabs being bent when the wings are in a free flight position.

10. A bird shaped toy glider comprised of Styrofoam and including a body, the body having a laminated head structure, a metal weight embedded in the head between the laminations of the head structure for balancing the glider, a collapsible wing structure including a pair of rotatable wings mounted on the body behind the head, the body having its center of gravity at a medial point between opposite ends of the body, a tail structure mounted on a rear end of the body, a stationary pivot pin fixedly secured with and extending through said body behind said wings, a pair of tough sturdy bendable synthetic plastic tabs each rotatably mounted at one end on said pivot pin and with the tabs being on opposite sides of said body, said tabs being secured with one of said wings at an opposite tab end, the tabs being flat when said wings are in a "glider launch position" and being bent when in a "free flight position", and resilient spring-like means attached to the body forward of the synthetic plastic tabs to aid in more promptly bringing the wings to the "free flight" position and biasing the collapsible wing structure on the body permitting the collapsible wings to be pivoted about said stationary pivot pin in a 90° forward direction from the "free flight position" and further permitting the wings to be folded back into flat abutment against opposite sides of the body in a direction rearward of the center of gravity of the toy glider into the "glider launch position", the wings being positioned behind said stationary pivot pin on opposite sides of said body when the wings are in the "glider launch position" for assisting in stabilizing the wings before the glider is launched, the pivot pin being positioned above the wings in stabilizing abutment therewith when the wings are in the "free flight position", said means cooperating with the wings enabling them to be rotated with said tough sturdy bendable synthetic plastic tabs on said stationary pivot enabling the wings to be actuated from their "glider launch position" into the "free flight position" when air pressure from launching has diminished sufficiently so that the said resilient spring-like means can then force the wings to be rotated back into the "free flight position".

11. The bird shaped toy glider of claim 10 further characterized by stationary stop means fixedly secured on said body positioned above said stationary pivot pin and being cooperable with inside edges of the wings on opposite sides of the body to inhibit rotational movement of upper edges of the wings to a point forwardly of the stationary pivot pin when said collapsible wing structure is in its "glider launch position".

12. The bird shaped toy glider of claim 10 further characterized by the pivot pin comprising a wooden pin extending through the body, and means fixedly securing the pivot pin to said body to prevent its accidental disengagement from the body.

13. A bird shaped toy glider of claim 12 further characterized by the center of gravity of the bird shaped toy glider being located rearwardly immediately behind said pivot pin.

14. The bird shaped toy glider of claim 10 further characterized by said means comprising a rubber band extending through a hole in said body at a point above said stationary pivot and being attached at its opposite ends to a topside of said wings to impose a force upon said wings tending to cause the wings to move from said "glider launch position" to said "free flight position", said rubber band being stretched beneath and engaged against an underside of said pivot pin when the collapsed wings are in their "glider launch position" to assist in controlling the movement of the rubber band and the wings as the collapsed wings move to said "free flight position".

15. The bird shaped toy glider of claim 10 further characterized by said eyelet means each having a tab end embedded in fixed attachment with an inside edge of an associated one of said wings.

16. The bird shaped toy glider of claim 10 further characterized by including a U-shaped clip and with the U having its closed end engaged against an upper edge of the body when the wings are in said "free flight position" and with said U-shaped clip spaced from the body and overlying the pivot when said wings are in said "glider launch position", and opposite free ends of the U-shaped clip being joined with said wings in assembly therewith.

17. The bird shaped toy glider of claim 10 further characterized by the glider having a weight not exceeding ½ oz.

18. The bird shaped toy glider of claim 10 further characterized by stationary stop means fixedly secured on said body positioned above said stationary pivot pin and being cooperable with inside edges of the wings on opposite sides of the body to inhibit rotational movement of upper edges of the wings to a point forwardly of the stationary pivot pin when said collapsible wing structure is in its "glider launch position".

19. The bird shaped toy glider of claim 10 further characterized by eyelet means being provided for securing the inside edge of each wing to said stationary pivot pin, said eyelet means each having tab end embedded in fixed attachment with an inside edge of the associated one of the wings in assembly therewith, the wing structure, when in its "glider launch position" having its eyelet means holding an innermost edge of each associated wing in spaced relation to said stationary pivot pin and with an upper edge portion of each wing being engaged against said upper stationary pivot pin and with said rubber band serving to maintain these engagements of the wing structure with the respective pins, the eyelet means cooperating with the rubber band and the stationary pivot pin to maintain the engagement of the wing structure with the stationary stop means when said wings are in said "glider launch position".

* * * * *